US011391064B2

(12) United States Patent
Almomani et al.

(10) Patent No.: US 11,391,064 B2
(45) **Date of Patent: *Jul. 19, 2022**

(54) ELECTRONIC LOCK SYSTEM HAVING PROXIMITY MOBILE DEVICE

(71) Applicant: Spectrum Brands, Inc., Middleton, WI (US)

(72) Inventors: Nedal Almomani, Mission Viejo, CA (US); Thuan Nguyen, Mission Viejo, CA (US); Elena Gorkovenko, Mission Viejo, CA (US); Wei Hsu, Lake Forest, CA (US); Yos Singtoroj, Anaheim, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/362,023

(22) Filed: Mar. 22, 2019

(65) Prior Publication Data

US 2019/0284839 A1 Sep. 19, 2019

Related U.S. Application Data

(63) Continuation of application No. 14/102,560, filed on Dec. 11, 2013, now Pat. No. 10,240,365.

(Continued)

(51) Int. Cl.
*G07C 9/00* (2020.01)
*E05B 47/00* (2006.01)

(52) U.S. Cl.
CPC ..... *E05B 47/0001* (2013.01); *G07C 9/00309* (2013.01); *G07C 2209/08* (2013.01);

(Continued)

(58) Field of Classification Search
CPC . E05B 47/0001; E05B 17/22; G07C 9/00309; G07C 2209/08;

(Continued)

(56) References Cited

U.S. PATENT DOCUMENTS 4,783,638 A 11/1988 Mamodaly et al.
5,729,057 A 3/1998 Frenzel et al.

(Continued)

FOREIGN PATENT DOCUMENTS

EP 0753822 A2 1/1997
EP 1835436 A2 9/2007

(Continued)

OTHER PUBLICATIONS

International Search Report for Application No. PCT/US13/66189, dated Feb. 6, 2014.

(Continued)

*Primary Examiner* — Vernal U Brown
(74) *Attorney, Agent, or Firm* — Merchant & Gould P.C.

(57) ABSTRACT

An electronic lock, such as a deadbolt, with a locking device movable between a locked position and an unlocked position. The lock includes a key fob including a RFID circuit indicative of a valid access code for the locking device. A circuit is provided that is configured to control movement of the locking device between the locked position and the unlocked position. The circuit includes a sensor, such as a contract sensor or a proximity sensor, which detects when a user is within range of a RFID device. When this happens, the sensor is configured to generate an electrical signal, which is used to activate the RFID device for a predetermined period of time. If the RFID device reads a valid access code, the device is unlocked.

20 Claims, 6 Drawing Sheets

Related U.S. Application Data

(60) Provisional application No. 61/736,345, filed on Dec. 12, 2012.

(52) U.S. Cl.
CPC ..... *G07C 2209/64* (2013.01); *G07C 2209/65* (2013.01); *Y10T 70/7062* (2015.04)

(58) Field of Classification Search
CPC ..... G07C 2009/00769; G07C 9/00182; E05Y 2900/132
USPC ..... 340/5.7
See application file for complete search history.

(56) References Cited

U.S. PATENT DOCUMENTS

| | | | | |
|---|---|---|---|---|
| 5,739,766 | A | 4/1998 | Chaloux | |
| 5,841,390 | A | 11/1998 | Tsiu | |
| 6,038,895 | A | 3/2000 | Menke et al. | |
| 6,209,367 | B1 | 4/2001 | Hyatt, Jr. | |
| 6,370,381 | B1 | 4/2002 | Minnick et al. | |
| 6,411,199 | B1 * | 6/2002 | Geiszler | G06K 7/0008 340/10.1 |
| 6,577,226 | B1 | 6/2003 | Steiner | |
| 6,906,612 | B2 | 6/2005 | Ghabra et al. | |
| 6,937,140 | B1 | 8/2005 | Outslay et al. | |
| 6,967,562 | B2 | 11/2005 | Menard et al. | |
| 9,109,378 | B2 | 8/2015 | Scalisi | |
| 9,674,124 | B1 | 6/2017 | Fisher et al. | |
| 10,240,365 | B2 * | 3/2019 | Almomani | G07C 9/00309 |
| 10,783,731 | B2 | 9/2020 | Imanuel | |
| 2003/0137404 | A1 | 7/2003 | Bonneau et al. | |
| 2003/0151493 | A1 | 8/2003 | Straumann et al. | |
| 2006/0255909 | A1 | 11/2006 | Pavatich et al. | |
| 2007/0290792 | A1 | 12/2007 | Tsuchimochi et al. | |
| 2008/0011032 | A1 | 1/2008 | Groff | |
| 2008/0180211 | A1 * | 7/2008 | Lien | E05B 47/0615 340/5.61 |
| 2009/0256366 | A1 | 10/2009 | Abe | |
| 2009/0256677 | A1 | 10/2009 | Hein et al. | |
| 2010/0283579 | A1 | 11/2010 | Kraus et al. | |
| 2010/0294008 | A1 * | 11/2010 | Bogdanov | E05B 47/0692 70/277 |
| 2011/0063076 | A1 * | 3/2011 | Kurtz | B60R 25/00 340/5.61 |
| 2011/0234377 | A1 | 9/2011 | Landuyt et al. | |
| 2012/0157080 | A1 | 6/2012 | Metivier | |
| 2012/0196588 | A1 | 8/2012 | Shah | |
| 2012/0213362 | A1 | 8/2012 | Bliding et al. | |
| 2012/0280783 | A1 | 11/2012 | Gerhardt et al. | |
| 2013/0176107 | A1 * | 7/2013 | Dumas | G07C 9/00571 340/5.61 |
| 2013/0210360 | A1 | 8/2013 | Ljung et al. | |
| 2013/0241694 | A1 | 9/2013 | Sharma et al. | |
| 2013/0293351 | A1 | 11/2013 | Kuenzi et al. | |
| 2013/0295986 | A1 | 11/2013 | Mueck | |
| 2013/0342314 | A1 | 12/2013 | Chen et al. | |
| 2014/0028438 | A1 | 1/2014 | Kuenzi et al. | |
| 2014/0145823 | A1 | 5/2014 | Aase | |
| 2014/0191848 | A1 | 7/2014 | Imes et al. | |
| 2014/0375421 | A1 | 12/2014 | Morrison et al. | |
| 2015/0027178 | A1 | 1/2015 | Scalisi et al. | |
| 2015/0040205 | A1 | 2/2015 | Van Till et al. | |
| 2015/0101369 | A1 | 4/2015 | Scalisi | |
| 2015/0170448 | A1 | 6/2015 | Robfogel et al. | |
| 2015/0199859 | A1 | 7/2015 | Ouyang et al. | |
| 2015/0269799 | A1 | 9/2015 | Martinez et al. | |

FOREIGN PATENT DOCUMENTS

| | | | |
|---|---|---|---|
| KR | 10-1470747 | B1 | 12/2014 |
| WO | 0065551 | A1 | 11/2000 |
| WO | 2009088901 | A1 | 7/2009 |
| WO | 2009158181 | A1 | 12/2009 |
| WO | 2010012463 | A2 | 2/2010 |
| WO | 2011109005 | A1 | 9/2011 |

OTHER PUBLICATIONS

International Search Report for Application No. PCT/US2013/66816, dated Feb. 19, 2014.
USPTO: Office Action for U.S. Appl. No. 14/059,625, dated Aug. 27, 2015.

* cited by examiner

ELECTRONIC LOCK SYSTEM HAVING PROXIMITY MOBILE DEVICE

RELATED APPLICATIONS

The present application is a continuation of U.S. patent application Ser. No. 14/102,560, filed Dec. 11, 2013, now U.S. Pat. No. 10,240,365; which claims priority to U.S. Provisional Patent Application Ser. No. 61/736,345, filed on Dec. 12, 2012, entitled "Electronic Lock System Having Proximity Mobile Device." The subject matter disclosed in above applications is hereby expressly incorporated by reference into the present application in its entirety.

TECHNICAL FIELD

The present invention relates generally to electronic locks, and, more particularly, to an electronic lock system having a proximity mobile device.

BACKGROUND AND SUMMARY

A typical non-electronic door lock includes a key which must be inserted by a user into the lock and manipulated to unlock the lock to facilitate entry through the door. While electronic locks may eliminate, or provide an alternative to, the use of a key, typically the user must enter a code on a keypad having multiple buttons to facilitate lock operation. As such, in either case, substantial user interaction with the lock is required in order to unlock the lock. Accordingly, there is a need for a system that reduces the amount of user interaction required to operate a lock.

According to one aspect, the present invention provides a mobile device, such as a key fob, that has been pre-associated with an electronic lock, and wherein the user carrying the mobile device merely needs to touch the electronic lock, or the escutcheon or touch plate near the lock, in order to establish communications between the mobile device and the electronic lock to automatically operate the lock mechanism of the electronic lock.

According to another aspect, the invention provides an electronic lock, such as a deadbolt, with a locking device movable between a locked position and an unlocked position. The lock includes a key fob including a RFID circuit indicative of a valid access code for the locking device. A circuit is provided that is configured to control movement of the locking device between the locked position and the unlocked position. In one embodiment, the circuit includes a contact sensor having a contact region. The contact sensor is configured to generate an electrical signal responsive to detecting contact with the contact region. The circuit includes a RFID device configured to wirelessly receive an access code from a RFID circuit in range of the RFID device. The circuit includes a processing unit in electrical communication with the contact sensor and RFID device. The processing unit is configured to selectively activate the RFID device for a predetermined time period responsive to receiving the electrical signal from the contact sensor. The processing unit is configured to actuate movement of the locking device to the unlocked position responsive to the RFID device reading the valid access code.

In some embodiments, the contact sensor could be a capacitive sensor, an inductive sensor or a pressure sensor. In some cases, the lock includes an exterior escutcheon operatively associated with the locking device and the contact sensor is incorporated into the exterior escutcheon. Depending on the circumstances, the lock may include an interior escutcheon operatively associated with the locking device with a second contact sensor incorporated into the interior escutcheon.

In some embodiments, the sensor could be a non-contact sensor that is used to activate the RFID device. For example, the sensor could be a proximity sensor configured to detect the presence of a user within a range of the locking device without any physical contact of the proximity sensor. The proximity sensor is configured to generate an electrical signal responsive to detecting the presence of a user within the range of the locking device. In some cases, the proximity sensor could be an infrared sensor. Depending on the circumstances, the processing unit could be configured to determine whether the key fob is on an exterior side of a door by performing RF triangulation with the RFID device.

In a further aspect, the invention provides an electronic lock with a latch assembly including a bolt movable between an extended position and a retracted position. The lock includes a circuit configured to control movement of the bolt between the extended and retracted positions. In some cases, the circuit includes a sensor configured to generate an electrical signal responsive to detecting either: (1) the presence of a user within a range of the locking device without any physical contact of the sensor; or (2) physical contact with a contact region of the sensor. The circuit may include a RFID device configured to wirelessly read an access code from a mobile device. Non-transitory computer-readable medium could be provided that has a valid access code and a computer program code stored thereon. The circuit includes a processing unit in communication with the proximity sensor, RFID device, and the computer-readable memory. The processing unit is configured to carry out instructions in accordance with the computer program code, wherein the computer program code, when executed by the processing unit, causes the processing unit to perform operations comprising: (1) receiving an electrical signal from the sensor; (2) activating the RFID device for a predetermined time period responsive to receiving the electrical signal from the sensor; (3) receiving an access code from the RFID device; (3) determining whether the access code received from the RFID device is the valid access code; and (4) initiating the actuation of the bolt to the retracted position responsive to determining the access code is the valid access code.

Additional features and advantages of the invention will become apparent to those skilled in the art upon consideration of the following detailed description of the illustrated embodiment exemplifying the best mode of carrying out the invention as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE DRAWINGS

Figure 1A:
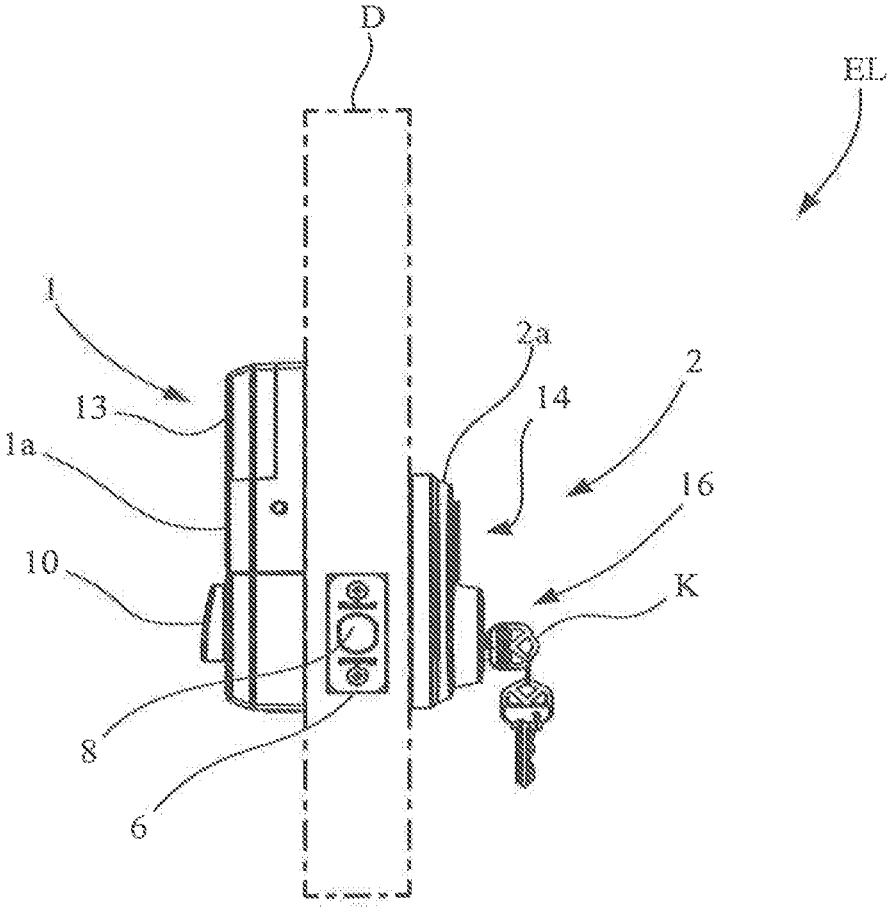
FIG. 1A is a side view of an electronic lock in accordance with an embodiment of the present invention, installed on a door and with the door shown in phantom lines.
Figure 1B:
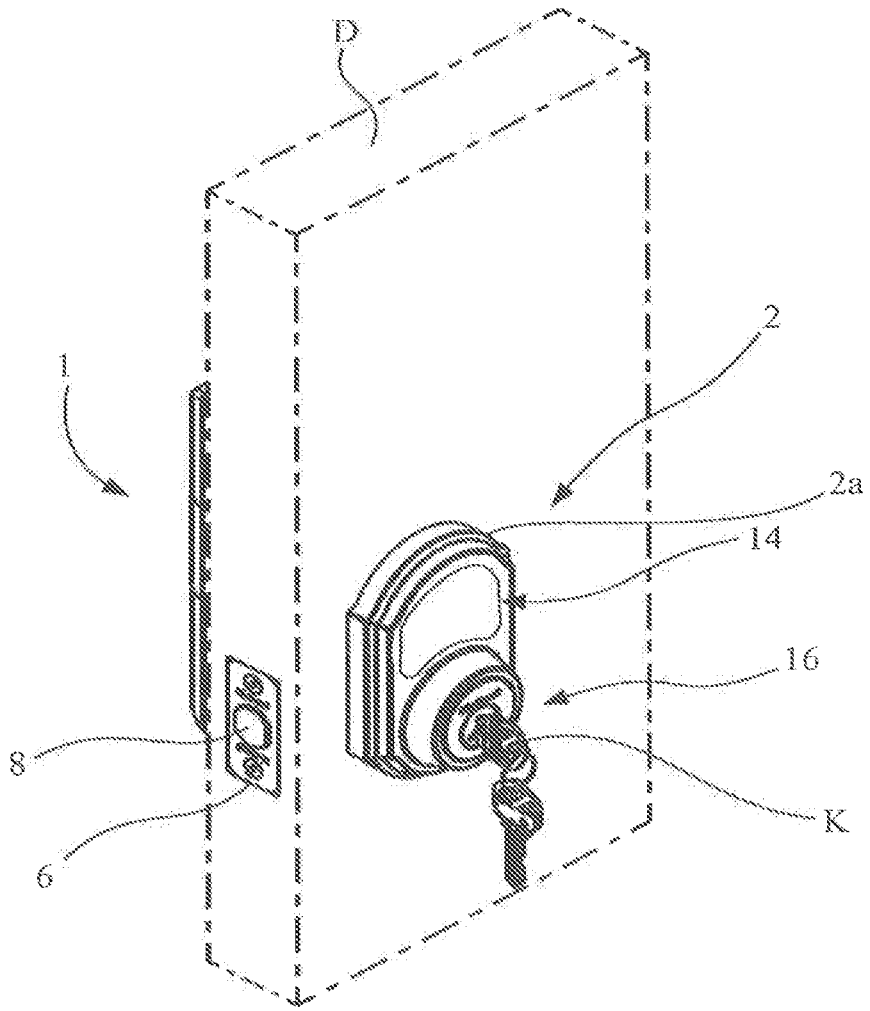
FIG. 1B is a perspective view of the electronic lock of FIG. 1A, as viewed from the exterior of the door.
Figure 1C:
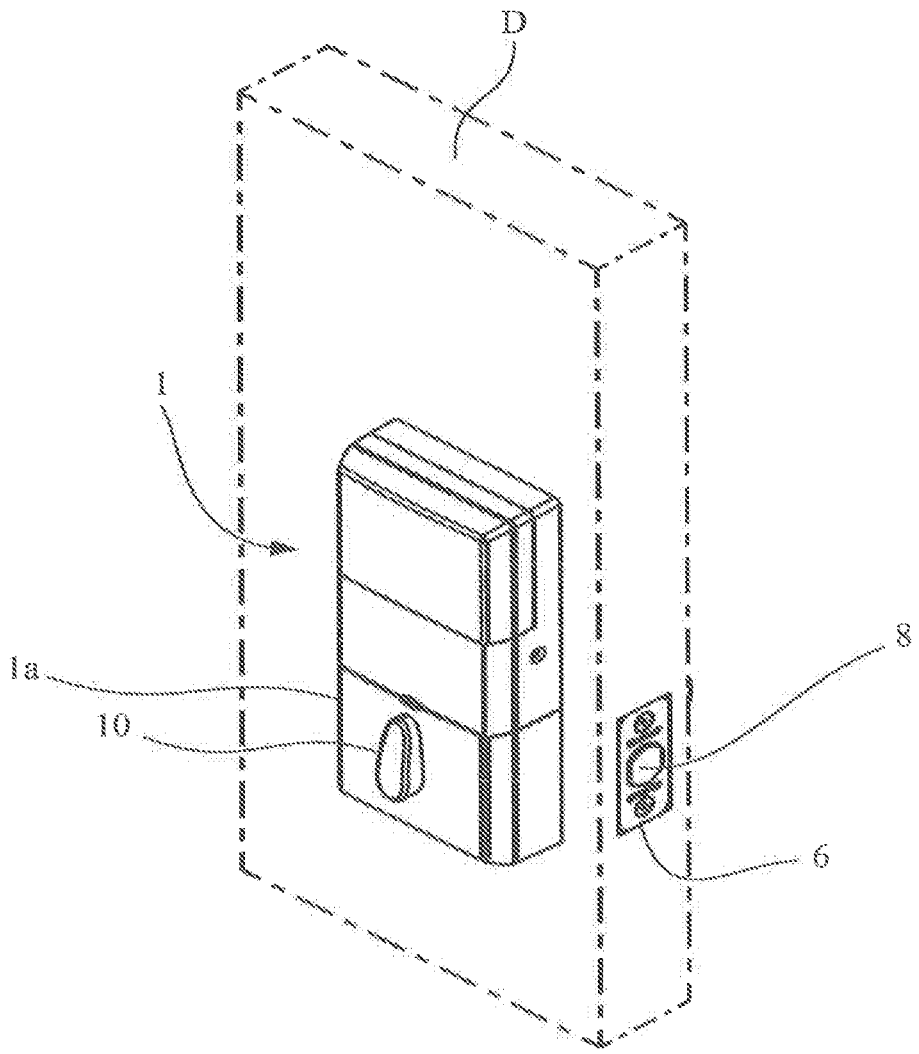
FIG. 1C is a perspective view of the electronic lock of FIG. 1A as viewed from the interior of the door.

Referring now to the drawings and particularly to FIGS. 1A-1C and 2, there is shown an electronic lock (EL) in accordance with the present invention for mounting on a door D, and which includes an interior chassis 1 having an interior escutcheon 1*a*, an exterior chassis 2 having an exterior escutcheon 2*a*, a mounting plate 3, an adapter 4, a latch assembly 5, and a strike 6.

Figure 2:
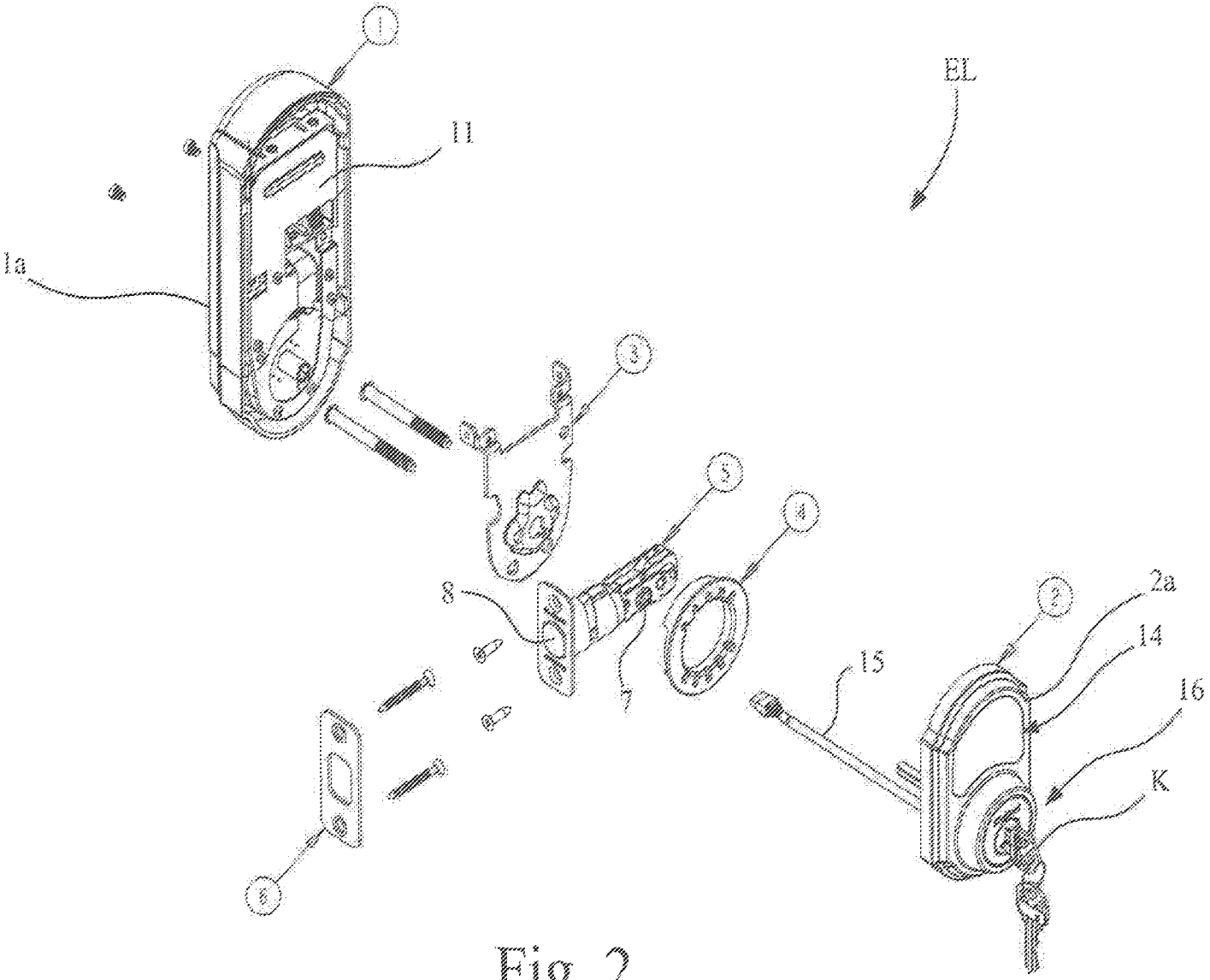
FIG. 2 is an exploded view of the electronic lock of FIGS. 1A-1C.

As shown in FIG. 2, latch assembly 5 is of a configuration well known in the art, and includes a bolt actuator mechanism 7, and a bolt 8. Mounting plate 3 is used to mount the electronic lock to the door D. Adapter 4 is used to adapt the electronic lock to a particular hole opening in the door D.

For manual operation of electronic lock (EL), a key actuator 16, having a removable key K, is provided to manually operate latch assembly 5 from the exterior of the door D.

Figure 3:
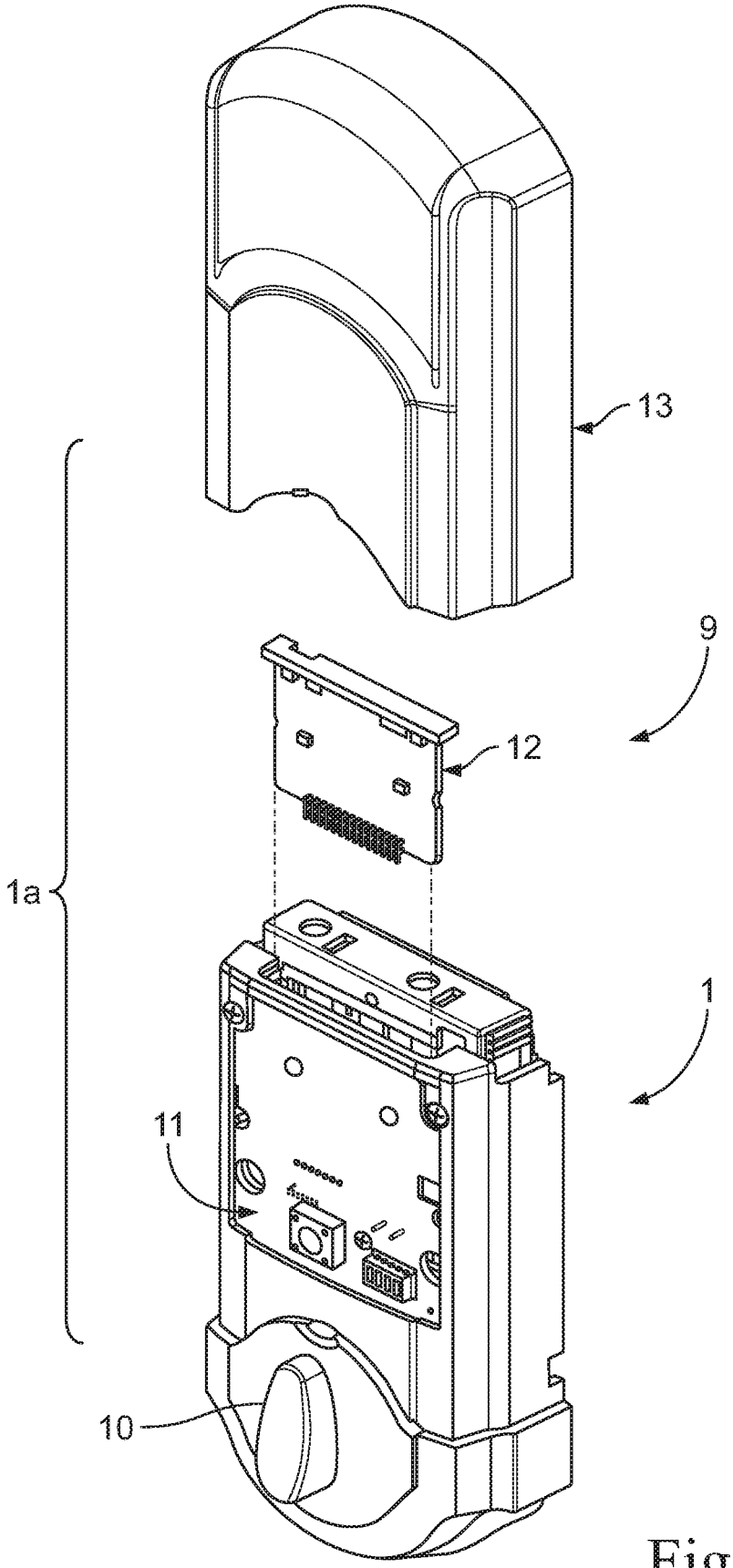
FIG. 3 is a perspective view of the interior chassis of the electronic lock of FIG. 2, with the upper cover and daughter card removed.

Referring also to FIG. 3, interior chassis 1 includes the electronic circuitry 9 for the electronic lock, and further includes a manual turnpiece 10. Manual turnpiece 10 is used on the interior side of door D to operate the bolt actuator mechanism 7 of latch assembly 5, and in turn to extend and retract bolt 8 (see also FIG. 1C). The electronic circuitry 9 includes a base board 11 and a removable daughter card 12. In FIG. 3, a removable cover 13 is provided to cover over the base board 11 and daughter card 12, when cover 13 is in the installed position.

Referring again to FIGS. 1A, 1B, 2 and 3, in accordance with an aspect of the present invention, exterior chassis 2 includes a contact sensor 14 that provides a contact region for user input, and is configured such that when the surface of contact sensor 14 comes in contact with a user, e.g., the user's hand, then a dormant communications portion of electronic circuitry 9 will be activated. Contact sensor 14 is electrically connected to the base board 11 of electronic circuitry 9, such as for example, by an electrical cable 15. Contact sensor 14 may be, for example, a capacitive sensor, an inductive sensor, or a pressure sensor, that generates a signal S when touched by a user, which in turn is sent to electronic circuitry 9. While contact sensor 14 is shown incorporated into exterior escutcheon 2*a*, it is contemplated that contact sensor 14 may be incorporated into other features near the lock area, such as on the lock face, or a dedicated contact pad could be provided. Also, it is contemplated that in some systems, it may be desirable to have an additional contact sensor that is accessible at the interior side of the door, e.g., at interior escutcheon 1*a*.

As an alternative embodiment, contact sensor 14 may be replaced with a proximity sensor, e.g., an infrared sensor, which detects the approach of a user and generates signal S without requiring the user to physically contact the sensor.

Referring particularly to FIG. 3, daughter card 12 of electronic circuitry 9 is a replaceable wireless communications module that facilitates wireless communications with an external device through a desired wireless communications protocol, e.g., Zigbee, Z-wave, etc. As such, electronic circuitry 9 may include, for example, an EMBER Corporation EM357 chip along with associated devices to handle all IEEE 802.15.4 operations. The chip and associated devices are driven by a 24.00 MHz crystal which is used to produce other internal clocks. Additional devices, such as LED's, switches, other integrated circuits, antenna, and others are designed into electronic circuitry 9.

Figure 4:
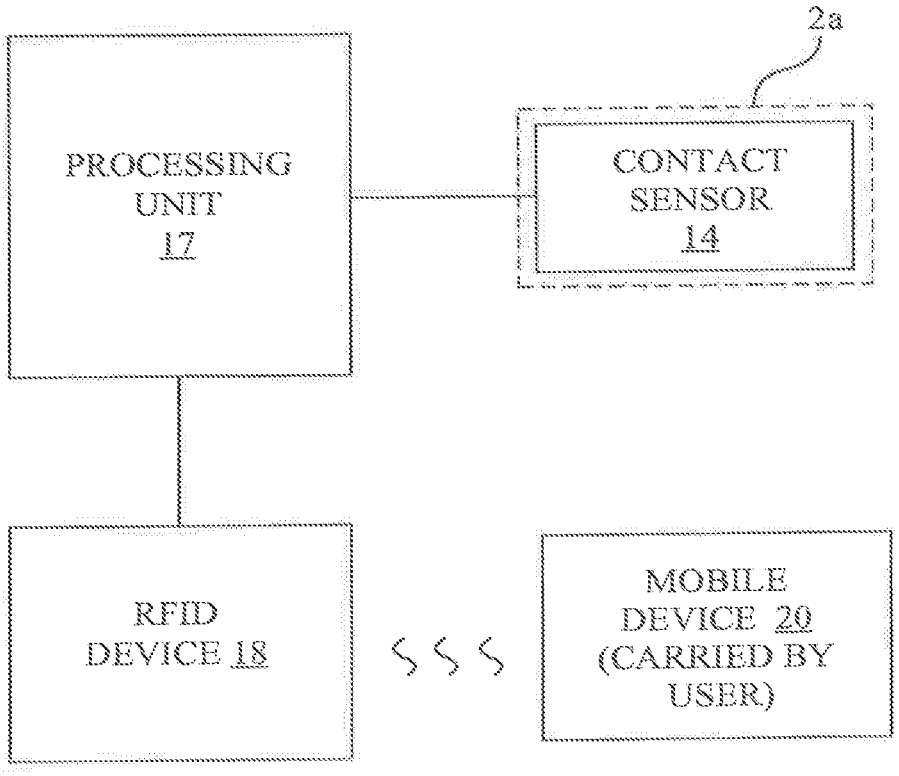
FIG. 4 is a block diagram of a portion of the electronics circuitry of the interior chassis of FIG. 3 in wireless communication with a mobile device, in accordance with an aspect of the present invention.

Referring to FIG. 4, electronic circuitry 9 also includes a processing unit 17 and a radio-frequency identification (RFID) device 18. Processing unit 17 includes a commercially available microprocessor or a custom built processing unit (ASIC=Application Specific Integrated Circuit) and associated input/output (I/O) circuitry, and is configured for electronic communication with contact sensor 14 and RFID device 18. Processing unit 17 may be communicatively coupled to contact sensor 14 and RFID device 18 via electrical wiring.

RFID device 18 may be a standard RFID reader device known in the art, having a maximum communication range of about 3 feet, e.g., the factory default. In an embodiment of the present invention, RFID device 18 includes an electrically powered RFID circuit reader, which may be incorporated, for example, into daughter card 12. RFID device 18 is configured to be selectively activated by an actuation of contact sensor 14, as further described below.

As a part of the system in some embodiments, there is also included a user carried mobile device 20 configured to communicate with RFID device 18 when RFID device 18 is activated. User carried mobile device 20 has an embedded RFID circuit that contains lock information, such as an access code, that operatively associates mobile device 20 with electronic lock (EL). In some embodiments, the lock information is preprogrammed into mobile device 20, and may be configured to correspond to a particular electronic lock, or to a set of electronic locks. Mobile device 20 may be, for example, a key fob. Alternatively, the key fob could be in the form of a RFID circuit attached to key.

As is typical in the art, the RFID circuit of mobile device 20 receives electrical power via electromagnetic induction from the reader circuit of RFID device 18 when the RFID circuit of mobile device 20 is within the communications range of RFID device 18. However, such communication is only possible when RFID device 18 is activated. RFID device 18 establishes electromagnetic induction through a RFID antenna that is embedded in exterior chassis 2 (see, e.g., FIG. 1A).

In an embodiment of the present invention, RFID device 18 is selectively activated for a predetermined period of time (e.g., 5 to 20 seconds) following the generation of the signal S by contact sensor 14. In operation, a user touches contact sensor 14 to generate signal S, which is then delivered to processing unit 17. Processing unit 17, upon receiving signal S, then activates RFID device 18 for communication. If RFID device 18 establishes communication with the mobile device 20, then RFID device 18 reads the RFID circuit of mobile device 20. Processing unit 17 then determines from the RFID information read from mobile device 20 whether mobile device 20 is authorized for use with electronic lock (EL).

If authorized, then processing unit 17 of electronic circuitry 9 responds by actuating the lock actuator mechanism, i.e., latch assembly 5, to unlock electronic lock (EL). The actuation of latch assembly 5 may be effected by energizing an electric motor (not shown) to retract the bolt 8 of latch assembly 5, thus permitting door D (see FIG. 1B) to be opened from a closed position. After the predetermined period of time has expired, electronic lock (EL) will return to the locked state.

In an embodiment where a non-contact proximity sensor is used as a replacement for contact sensor 14, electronic circuitry 9 is configured to determine that mobile device 20 is on the exterior side of the door by enabling RFID device 18 to perform RF triangulation prior to having the lock actuator mechanism energized by processing unit 17 of electronic circuitry 9. In addition, triangulation may be used as a technique to program the distance range within which the user carrying mobile device 20 must be in order to activate the electronic lock (EL) to an unlocked state. For example, the user programmable range may be a distance of 1 foot to 6 feet.

In operation, when a valid proximity mobile device 20, i.e., a proximity key fob, using RFID communication is within a predetermined range of electronic lock (EL) and the user touches a contact sensor 14 of electronic lock (EL) with the user's hand, or alternatively the user is within range of the alternative lock proximity sensor, then electronic lock (EL) will be activated to an unlocked state. In other words, the valid proximity mobile device 20 may remain in the user's pocket, but when the user touches a designated portion of electronic lock (EL) (e.g., escutcheon, face plate, handle, etc.), or alternatively approaches electronic lock (EL), then electronic lock (EL) automatically goes to an unlocked state.

Advantageously, in embodiments of the present invention, there is no need to manipulate the lock mechanism with a key or keypad in order to unlock the lock.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. An electronic lock for mounting on a door including an interior side, an exterior side, and an edge extending between the interior side and the exterior side, the door defining a bore extending between the interior side and the exterior side and including a side bore extending through the edge, the electronic lock for use with a mobile device including a wireless communication circuit indicative of a valid access code for a locking device, the electronic lock comprising:

the locking device comprising a bolt actuator mechanism, and a bolt movable between a locked position extending through the side bore and past the edge when installed on the door and an unlocked position corresponding to a retracted position in which the bolt is at least partially retracted into the side bore when installed on the door;

a circuit configured to control movement of the locking device between the locked position and the unlocked position, wherein the circuit includes:

a contact sensor having a contact region on the exterior side, wherein the contact sensor is configured to generate an electrical signal responsive to detecting contact with the contact region;

a second contact sensor having a second contact region on the interior side, wherein the second contact sensor is configured to generate a second electrical signal responsive to detecting contact with the second contact region;

a wireless communication device configured to:

initiate communication with the mobile device via a communication signal for a predetermined time period in response to the electrical signal or the second electrical signal; and wirelessly receive an access code from a wireless communication circuit of the mobile device in range of the wireless communication device in accordance with a wireless communication protocol in which the wireless communication circuit uses power received via the communication signal from the wireless communication device during the predetermined time period; and a processing unit in electrical communication with the contact sensor, the second contact sensor, and the wireless communication device, wherein the processing unit is configured to selectively activate the wireless communication device for the predetermined time period responsive to receiving the electrical signal from the contact sensor or the second electrical signal from the second contact sensor to initiate establishing communication with the mobile device, wherein the processing unit is configured to actuate movement of the locking device to the unlocked position responsive to the wireless communication device reading the valid access code.

2. The electronic lock of claim 1, wherein the contact sensor is a capacitive sensor.

3. The electronic lock of claim 1, wherein the contact sensor is an inductive sensor.

4. The electronic lock of claim 1, wherein the contact sensor is a pressure sensor.

5. The electronic lock of claim 1, further comprising an exterior escutcheon operatively associated with the locking device, wherein the contact sensor is incorporated into the exterior escutcheon.

6. The electronic lock of claim 5, further comprising an interior escutcheon operatively associated with the locking device, wherein the second contact sensor is incorporated into the interior escutcheon.

7. The electronic lock of claim 1, wherein the predetermined time period is between approximately 5 to 20 seconds.

8. The electronic lock of claim 1, further comprising:

an interior chassis mounted to the interior side of the door, the interior chassis including the circuit;

an exterior chassis mounted to the exterior side of the door, the exterior chassis including the contact sensor; and a circular-shaped adapter dimensioned to adapt at least a portion of the exterior chassis for a particular sized opening in the bore in the door, wherein the contact sensor is electrically connected to the circuit in the interior chassis using an electrical cable extending through the adapter.

9. The electronic lock of claim 1, wherein the mobile device is a key fob.

10. The electronic lock of claim 1, wherein the processing unit determines whether the mobile device is on the exterior side of the door by performing RF triangulation.

11. An electronic lock system for use with a mobile device, the electronic lock system comprising:

a mobile device including a wireless communication circuit;

a locking device comprising a bolt actuator mechanism and a bolt movable between a locked position and an unlocked position;

a circuit configured to control movement of the locking device between the locked position and the unlocked position, wherein the circuit includes:

a proximity sensor configured to detect the presence of a user within a range of the locking device without any physical contact of the proximity sensor, wherein the proximity sensor is configured to generate an electrical signal responsive to detecting the presence of a user within the range of the locking device;

a contact sensor having a contact region on the interior side, wherein the contact sensor is configured to generate a second electrical signal responsive to detecting contact with the contact region;

a wireless communication device configured to:

initiate communication with the mobile device via a communication signal for a predetermined time period in response to the electrical signal or the second electrical signal; and wirelessly read an access code from the mobile device in accordance with a wireless communication protocol, wherein the circuit of the mobile device uses power received via the communication signal from the wireless communication device during the predetermined time period; and a processing unit in electrical communication with the proximity sensor and wireless communication device, wherein the processing unit is configured to selectively activate the wireless communication device for the predetermined time period responsive to receiving the electrical signal from the proximity sensor or the second electrical signal from the contact sensor to initiate establishing communication with the mobile device, wherein the processing unit is configured to actuate movement of the locking device to the unlocked position responsive to the wireless communication device reading a valid access code.

12. The electronic lock system of claim 11, wherein the proximity sensor is an infrared sensor.

13. The electronic lock system of claim 11, wherein the predetermined time period is between approximately 5 to 20 seconds.

14. The electronic lock system of claim 11, wherein the processing unit is configured to determine whether the mobile device is on an exterior side of a door by performing RF triangulation with the wireless communication device.

15. The electronic lock system of claim 11, further comprising an exterior escutcheon operatively associated with the locking device, wherein the proximity sensor is incorporated into the exterior escutcheon.

16. The electronic lock system of claim 11, further comprising:

an interior chassis mounted to an interior side of a door, the interior chassis including the circuit;

an exterior chassis mounted to an exterior side of the door, the exterior chassis including the proximity sensor; and a circular-shaped adapter dimensioned to adapt at least a portion of the exterior chassis for a particular sized opening in a bore in the door, wherein the proximity sensor is electrically connected to the circuit in the interior chassis using an electrical cable extending through the adapter.

17. The electronic lock system of claim 11, wherein the mobile device is a key fob.

18. A method of using an electronic lock with a mobile device, the method comprising:

providing an electronic lockset mountable to a door, the door defining a bore extending between an interior side and an exterior side and including a side bore extending through an edge of the door, the lockset comprising:

a latch assembly including a bolt movable between an extended position in which the bolt extends past the edge of the door through the side bore and a retracted position in which the bolt is at least partially retracted into the side bore;

a circuit configured to control movement of the bolt between the extended and retracted positions, wherein the circuit includes:

a wireless communication device configured to:

initiate communication with the mobile device via a communication signal; and wirelessly read an access code from the mobile device, in accordance with a wireless communication protocol, in response to a determination of either (1) presence of a user or of the mobile device within a range of the electronic lockset; or (2) physical contact with a contact region of a sensor on the exterior side of the electronic lockset or a second contact region of a second sensor on the interior side of the electronic lockset, wherein the mobile device uses power received via the communication signal from the wireless communication device; and a non-transitory computer-readable medium having a valid access code and a computer program code stored thereon; and a processing unit in communication with the wireless communication device and the computer-readable memory, wherein the processing unit is configured to carry out instructions in accordance with the computer program code, the instructions causing the electronic lockset to perform:

activating the wireless communication device for a predetermined time period in response to the determination;

powering a wireless communication circuit of the mobile device during the predetermined time period via the communication signal of the wireless communication device;

receiving an access code from the mobile device;

determining whether the access code received from the wireless communication device is the valid access code; and initiating the actuation of the bolt to the retracted position responsive to determining the access code is the valid access code.

19. The method of claim 18, wherein the predetermined time period is between approximately 5 to 20 seconds.

20. The method of claim 18, wherein the sensor is one of a capacitive sensor, an inductive sensor, a pressure sensor, or an infrared sensor.

* * * * *